US005717178A

United States Patent [19]

Turner et al.

[11] Patent Number: 5,717,178

[45] Date of Patent: Feb. 10, 1998

[54] LOCKING MECHANISM FOR ELECTRICAL SWITCHES

[75] Inventors: David C. Turner, North Fayette; Craig J. Puhalla, Moon Township, Allegheny County; Thomas T. Kuzniarski, Coraopolis, all of Pa.

[73] Assignee: Eaton Corporation, Cleveland, Ohio

[21] Appl. No.: 595,925

[22] Filed: Feb. 6, 1996

[51] Int. Cl.[6] ..... H01H 9/20

[52] U.S. Cl. ..... 200/50.01

[58] Field of Search ..... 200/50.01, 50.02, 200/50.11, 43.11, 43.13, 43.16, 43.19, 43.22

[56] References Cited

U.S. PATENT DOCUMENTS

| | | | |
|---|---|---|---|
| 3,291,924 | 12/1966 | Tharp | 200/42 |
| 4,260,861 | 4/1981 | DiMarco | 200/42 |
| 4,631,373 | 12/1986 | Ochiai | 200/43.17 |
| 4,658,102 | 4/1987 | Seim et al. | 200/17 R |
| 4,920,620 | 5/1990 | Yamamoto et al. | 200/61.58 B |
| 5,077,991 | 1/1992 | Stickel et al. | 200/43.08 |

*Primary Examiner*—Matthew V. Nguyen
*Attorney, Agent, or Firm*—Martin J. Moran

[57] ABSTRACT

The handle of an electrical switch reciprocally movable in a slot in the switch housing is locked in a desired position by a locking mechanism which includes a base plate secured to the housing adjacent one end of the handle slot. A hasp member is hinged to the base plate at a hinge end for rotation about a hinge axis transverse to the path of reciprocal movement of the handle. The hasp member is rotatable between a locking position in which it overlaps the front end of the slot so that the handle cannot be moved away from the second end of the slot. A staple extending transversely from the base plate protrudes through an opening in the hasp member and has an opening for receiving one or more padlocks for locking the hasp member in the blocking position. In a second embodiment, the hasp member has a second opening through which the handle protrudes for locking the handle at the front end of the slot. Notches in arcuate fingers forming the hinge connection for the hasp member are engaged by sliding the hasp member axially on the hinge connection to latch the hasp member clear of the handle which allows unrestricted movement of the handle even with the switch mounted vertically.

19 Claims, 4 Drawing Sheets

FIG. 2
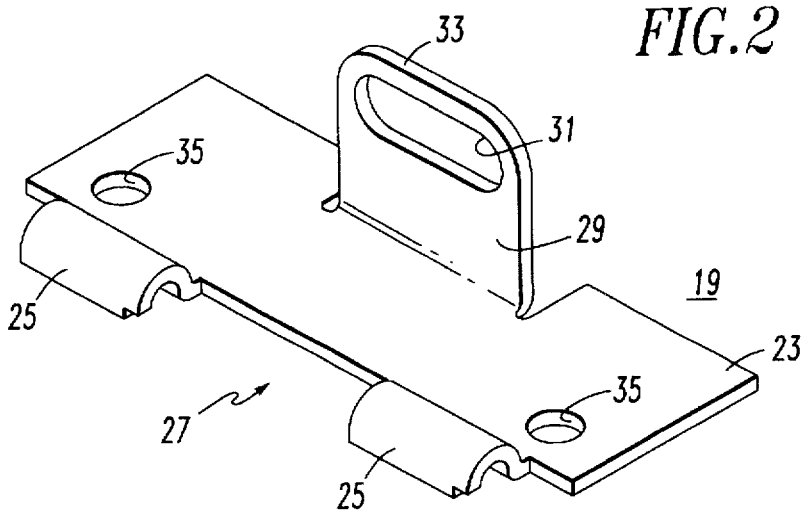
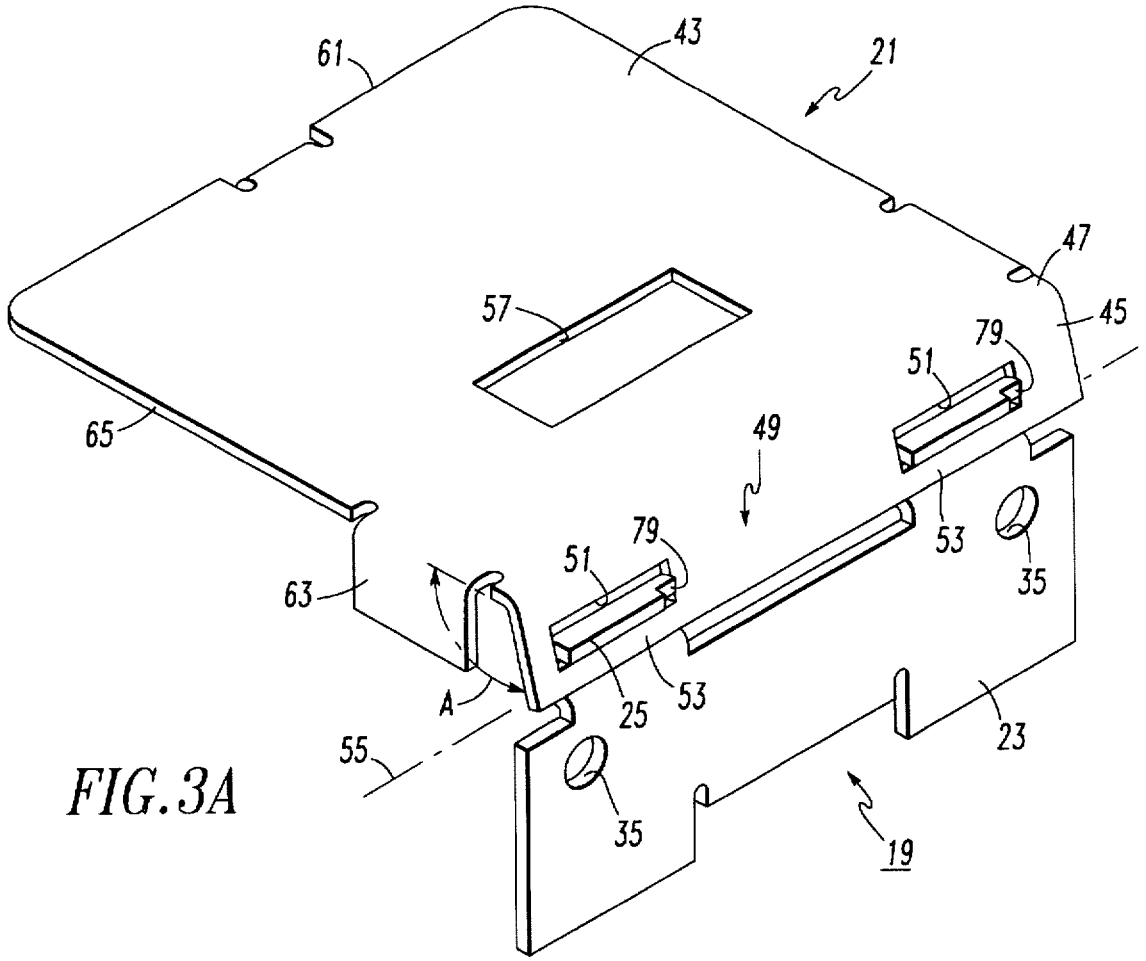
FIG. 3A

FIG. 3B
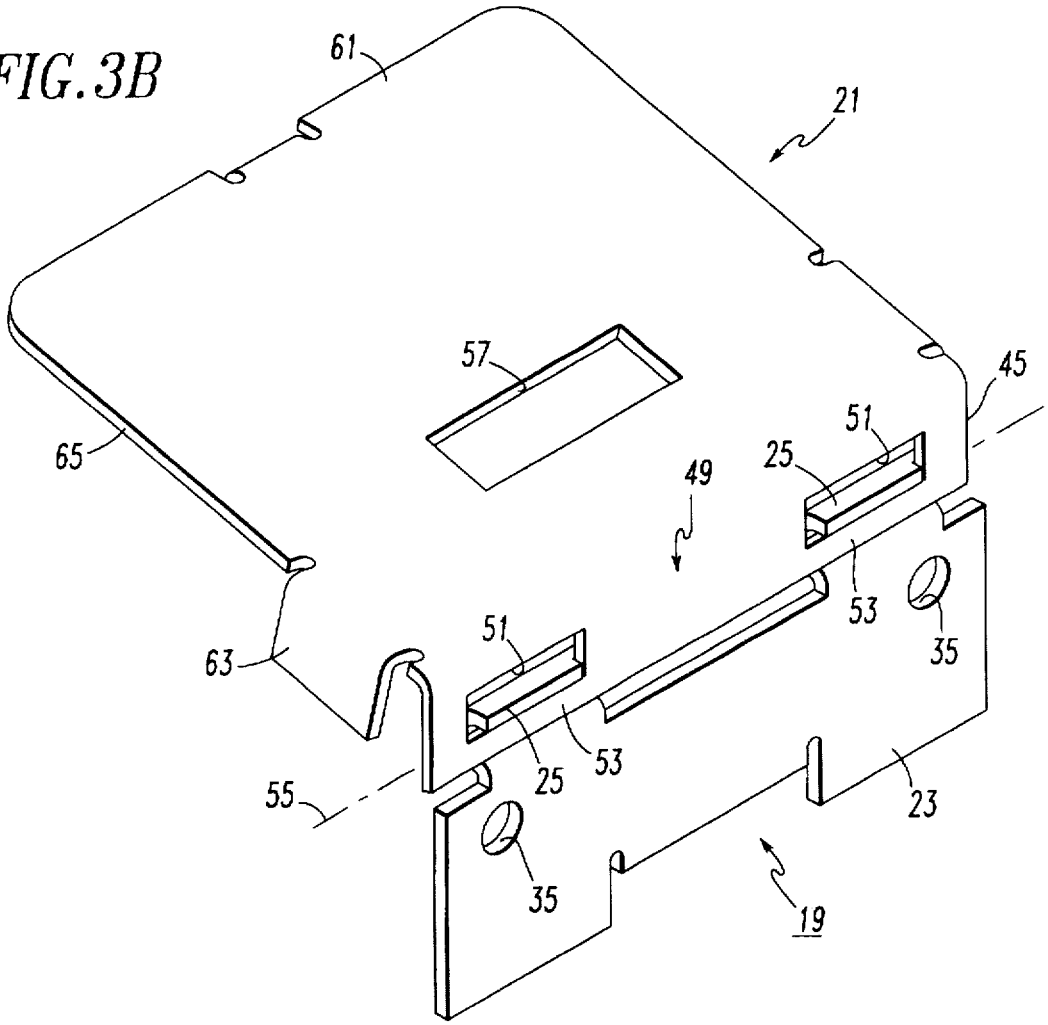
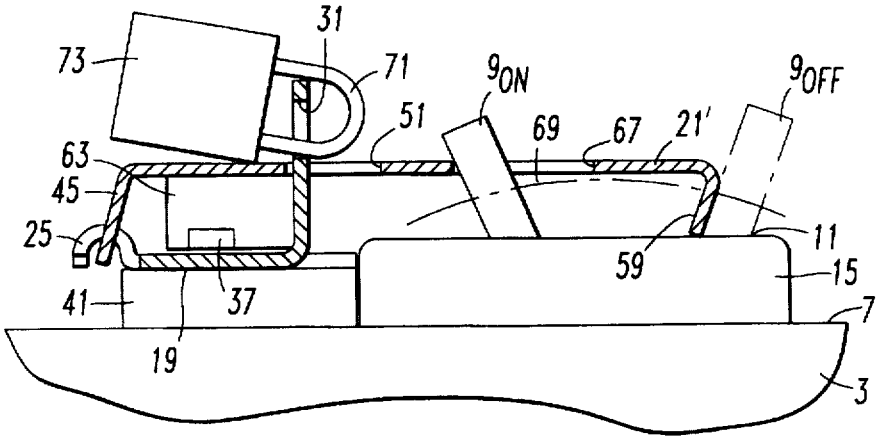
FIG. 5

LOCKING MECHANISM FOR ELECTRICAL SWITCHES

BACKGROUND OF THE INVENTION

1. Field of the Invention

This invention relates to mechanisms for mechanically locking electrical switches, either in the off or on position, and particularly to mechanisms for padlocking a handle which moves reciprocally within a slot.

2. Background Information

In many installations there is a need to lock electrical switches in either or both of the off and on positions. This includes circuit breakers which typically have a handle which moves reciprocally within a slot in the face of the circuit breaker housing. One locking mechanism for circuit breakers handles includes a hasp arrangement in which a hasp plate is hinged at one end to a base plate mounted to one side of the center of the handle slot. The hasp plate pivots about an axis parallel to the direction of movement on the handle to extend across the slot and block movement of the handle. A staple secured to the base plate extends through an opening in the hasp plate and forms an aperture for receipt of a padlock which secures the hasp plate in the blocking position.

This locking mechanism is effective, but has some limitations. It requires sufficient space on the side of the handle for mounting the base plate. Attempts to force the handle from the locked position apply a torque to the hinge perpendicular to the hinge axis, and also apply torque to the base plate and staple which can result in dislodging of the mounting screws.

There is no need for an improved locking mechanism for switches with handles which reciprocate within a slot and for switches incorporating the same.

There is a more particular need for such a locking mechanism which does not subject the mounting of the mechanism to the switch housing to torques which can tear the mechanism loose.

There is another need for an improved locking mechanism and switch incorporating the same which is rugged, reliable and easy and economical to manufacture and install.

There is an additional need for such an improved locking mechanism which remains in the unlocked position allowing unburdened movement of the handle even when the switch is mounted vertically.

SUMMARY OF THE INVENTION

These needs and others are satisfied by the invention which is directed to a mechanism for blocking movement of a switch handle which moves reciprocally in a slot in the face of switch housing, and the combination of such a mechanism with the switch. The handle locking mechanism includes a base plate secured to the switch housing adjacent a first end of the handle slot. The base plate has a first hinge member and a staple projecting outward from the face of the housing and terminating in a free end with a through aperture. A hasp member has a second hinge member at one end which engages the first hinge member of the base plate to define a hinge axis extending generally transversely to the path along which the handle reciprocates. The hasp member is rotatable about the hinge axis between a locking position in which the hasp member overlays at least a part of the slot to prevent movement of the handle within the slot, and an unlocked position in which the hasp member is rotated clear of the handle. The hasp member has a first opening through which the staple protrudes with the hasp member in the locking position. A lock, such as a padlock, engages the aperture in the staple to block rotation of the hasp member between the locking and unlocked positions. The hasp member has a length selected to form at the free end thereof an abutment which blocks movement of the handle away from the second end of the slot with the hasp member in the locking position.

In a second embodiment of the invention, the hasp member has a second opening aligned to receive the handle when the handle is adjacent the first end of the slot. This second opening is sized to prevent movement of the handle to the second end of the slot with the hasp member in the locking position. Preferably, where the switch is a circuit breaker, the circuit breaker is in the off position when the handle is at the second end of the handle slot. The second opening in the hasp member therefore retains the handle in the on position at the first end of the handle slot. This second opening can be made large enough that the handle can move to the intermediate, trip position should the circuit breaker trip.

As another aspect of the invention, the hinge members on the base plate and the hasp member support the hasp member for rotation about the hinge axis and for axial movement along the hinge axis between an unlatched position in which the hasp member is free to rotate about the hinge axis, and a latched position in which the hasp member is prevented from rotating about the hinge axis. This latch for the hasp member provides a means for holding the hasp member clear of the switch handle so that the switch handle can be freely moved. This is especially useful in installations where the switch is mounted vertically and the hasp member is hinged above the switch handle.

BRIEF DESCRIPTION OF THE DRAWINGS

A full understanding of the invention can be gained from the following description of the preferred embodiments when read in conjunction with the accompanying drawings in which:

FIG. 2 is an isometric view of a base plate in accordance with the invention.

FIGS. 3*a* and 3*b* are isometric views illustrating latching of the hasp member in the open position.

FIG. 5 is a fragmentary elevation view with some parts in sections illustrating operation of the embodiment of the invention using the hasp member of FIG. 4.

DESCRIPTION OF THE PREFERRED EMBODIMENT

The invention will be described in conjunction with a circuit breaker; however, it will be appreciated by those skilled in the art that the invention has application to other types of switches in which the switch handle reciprocates in a slot in a switch casing.

Figure 1:
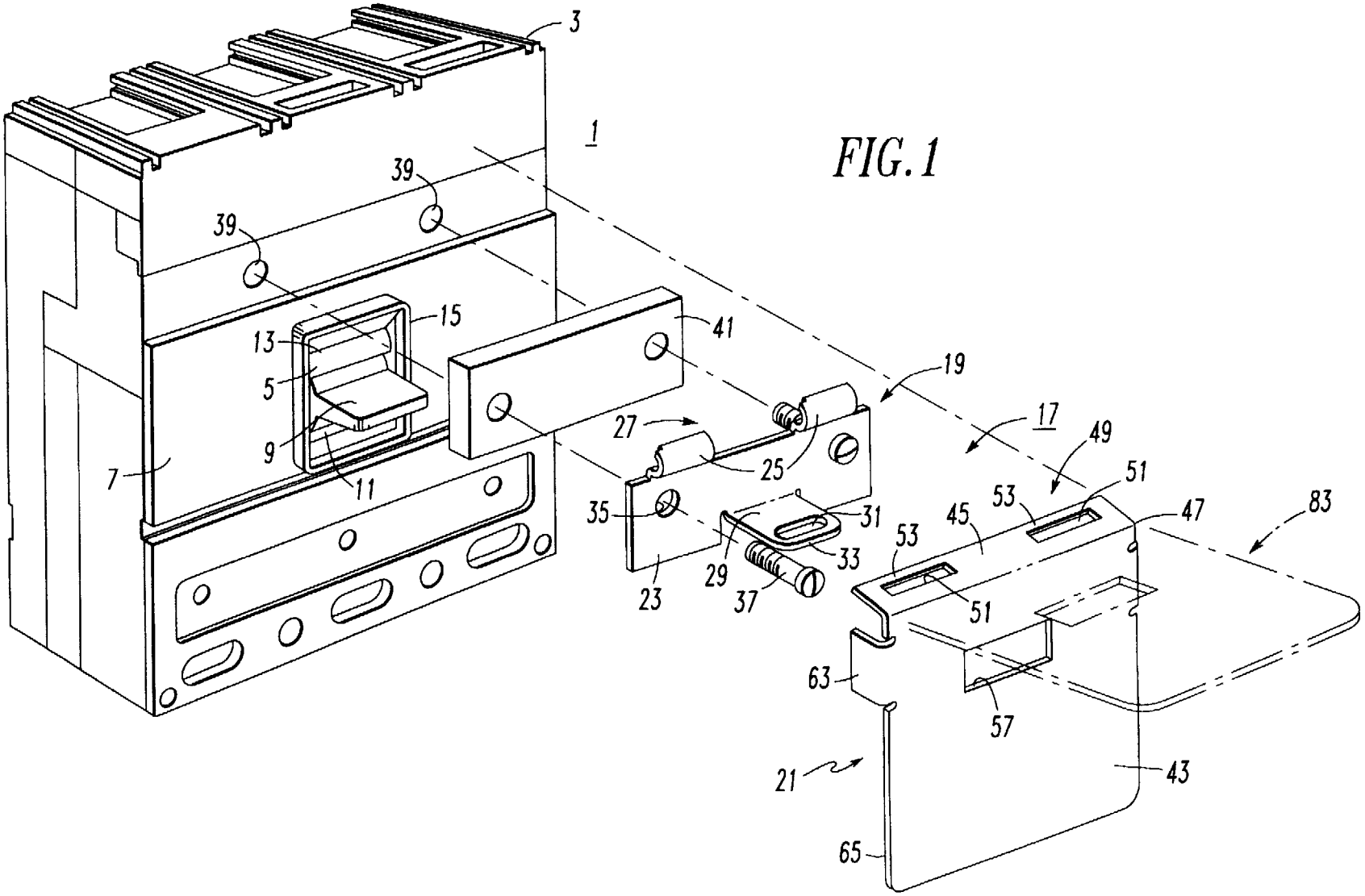
FIG. 1 is an exploded isometric view of a circuit breaker to which the invention has been applied.

Referring to FIG. 1, a circuit breaker 1 has a molded housing 3 with a handle slot 5 in a front face 7. A handle 9 is reciprocally moveable in the handle slot 5 between an off position at a first or lower end 11 of the slot 5 and an on position at a second, or upper, end of the handle slot 5. When the circuit breaker is tripped, the handle 9 assumes an intermediate position as shown in FIG. 1. The handle slot 5 is surrounded by an escutcheon 15.

In many applications, it is desirable to secure the circuit breaker from unauthorized operation. The handle locking mechanism 17 of the invention provides that security. The basic elements of the mechanism 17 are a base plate 19 and a hasp member 21. As best seen in FIG. 2, the base plate 19 has a planar body 23 with a pair of integral arcuate fingers 25 spaced apart along one edge to form a first hinge member 27. An elongated center section is bent generally at 90 degrees to the plane of the body 19 to form a staple 29 which has a through opening 31 at its free end 33. Mounting holes 35 in the planar body 23 receive mounting screws 37 which are threaded into tapped apertures 39 in the front face 7 of the circuit breaker molded casing 3. A mounting plate 41 spaces the base plate 19 from the front face 7.

Referring to FIGS. 3A and 3B, it can be seen that the hasp member 21 of the handle locking mechanism 17 has a planar body 43 with an integral flange 45 extending at an obtuse angle A of about 105° from a hinge end 47. A second hinge member 49 is formed by aligned slots 51 in the flange 45 which define pivots 53.

The first hinge member 49 of the hasp member 21 engages the first hinge member 27 on the base plate through engagement of the arcuate fingers 25 in the slots 51 to define a hinge axis 55.

The planar body 43 of the hasp member 21 has a first opening 57 for receiving the staple 29 in a manner to be described. The hasp member 21 also has an integral flange or finger 59 bent downward at the center of the free edge 61 at an acute angle to form an abutment surface for a purpose to be described. Integral tabs 63 extend downward from the side edges 65 of the planner body 43 adjacent the flange 45. The purpose of these tabs will also become apparent.

Figure 4:
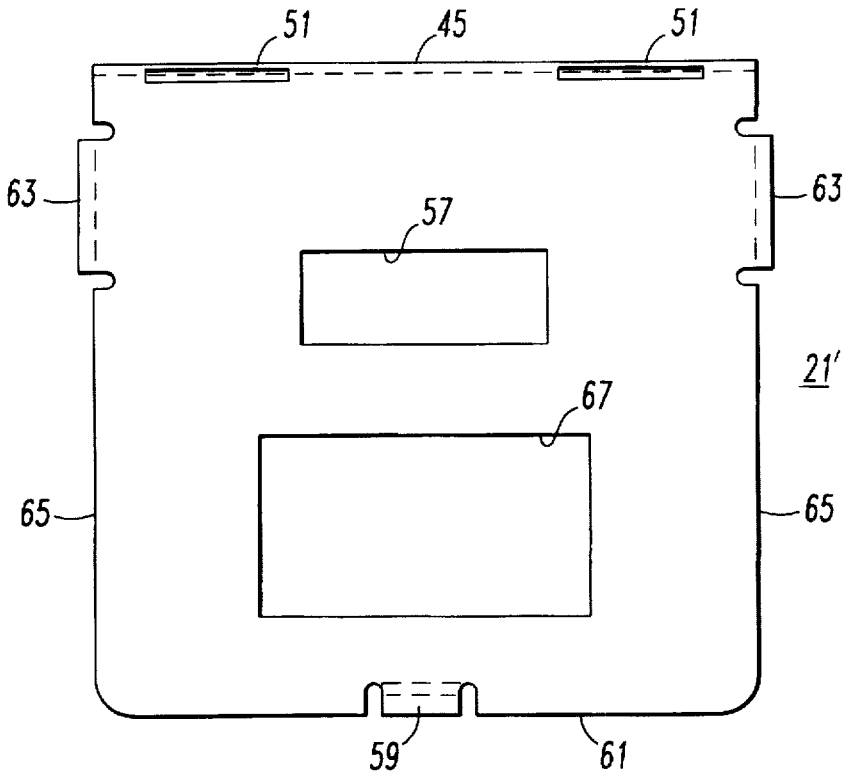
FIG. 4 is a plan view of a hasp member in accordance with another embodiment of the invention.

FIG. 4 illustrates a hasp member 21' in accordance with another embodiment of the invention. This form of the hasp member 21' has a second opening 67 for the handle 9 between the first opening 57 and the free edge 61.

In mounting the handle locking mechanism 17, the openings 51 in the flange 45 of the hasp member 21 are engaged with the arcuate fingers 25 on the base plate 19. The mounting screws 37 are then passed through the mounting holes 35 and through the mounting plate 41 to secure the assembly to the front face of the circuit breaker with the hinge axis 55 transverse to the path 69 that the handle follows in reciprocating in the handle slot 5. As shown in FIG. 5, with the handle 9 in the off position illustrated at 9 off, the hasp member is rotated about the pivot axis 55 so that it overlays at least a part of the handle slot 9. The integral finger 59 forms an abutment which maintains the handle 5 in the off position at the first end 11 of the handle slot. In this locking position, the staple 29 protrudes through the first opening 57 in the hasp member so that the hasp 71 of the padlock 73 can pass through the opening 31 to lock the hasp member 21 in the locking position shown. The opening 31 is large enough that additional padlocks can engage the opening in situations where multiple authorizations are needed to operate the circuit breaker 1).

When the embodiment of the hasp member 21' shown in FIG. 4 is used, the mechanism 17 can be used to also lock the handle in the on position 9 on in which it protrudes through the second opening 67 as shown in solid line in FIG. 5. This opening 67 can be made long enough so that in the case of the circuit breaker, the handle can assume the intermediate tripped position which provides a visual indication of the condition of the circuit breaker. While in this case the slot is long enough to allow manual movement of the handle to the intermediate position, this will not trip the circuit breaker, and the handle will return to the on position when released, as long as the contacts within the circuit breaker remain closed. If the circuit breaker is tripped, the mechanism 17 will not allow the circuit breaker to be reclosed without removal of the padlocks, as the handle must be moved past the off position before the contacts can be reclosed by movement of the handle to the on position.

It can be appreciated from FIG. 5, that the tabs 63 block access to the mounting screws 37 with the hasp member 21 in the locking position to preclude tampering and removal of the locking mechanism without opening the padlock.

As another aspect of the invention, the hasp member 21 can be latched in the unlocked or open position as seen in FIGS. 3A and 3B. The pivots 53 formed by the slots 51 in the flange 45 are of such a length relative to the length of the arcuate fingers 25 on the base plate that the entire hasp member 21 can slide axially along the hinge axis 55 relative to the base plate 19. Notches 79 in the arcuate fingers 25 form stops against which the hasp member seats. This latch is particularly useful when the circuit breaker 1 is mounted vertically as shown in FIG. 1. Raising the hasp member 21 and sliding it axially until the flange 45 engages the notches 79, supports the hasp member 21 in the fully open position 83 so that the handle 5 can be operated without hinderance.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electrical switch comprising:

a housing having a handle slot in its face;

a handle protruding through and reciprocally moveable along a path in said handle slot between an off position adjacent one end of said slot and an on position adjacent another end of said slot; and a handle locking mechanism comprising:

a base plate secured to said housing adjacent a first end of said slot, said base plate having a first hinge member and a staple projecting outward from said face of said housing between said first hinge member and said first end of said slot and terminating in a free end with a through aperture adjacent said free end; and a hasp member having a second hinge member for engaging said first hinge member on said base plate, said first and second hinge members defining a hinge axis extending generally transversely to said path along which said handle reciprocates, said hasp member being rotatable about said hinge axis between a locking position in which said hasp member overlays at least part of said slot to prevent movement of said handle in said slot, and an unlock position in which said hasp member is rotated clear of said handle, said hasp member having a first opening spaced from said second hinge member so that said staple protrudes through said first opening with said hasp member in said locking position; and a lock engaging said aperture in said staple to block rotation of said hasp member between said locking and unlocked positions.

2. The switch of claim 1 wherein said hasp member has a length selected to form at a free end an abutment which blocks movement of said handle away from a second end of said slot with said hasp member in said locking position.

3. The electrical switch of claim 2 wherein said hasp member has a second opening aligned to receive said handle when said handle is adjacent said first end of said slot, and sized to prevent movement of said handle to said second end of said slot with said hasp member in said locking position.

4. The electrical switch of claim 3 wherein said first hinge member and second hinge member comprise means for cooperatively selectively blocking rotation of said hasp member toward said locking position.

5. The electrical sand second him 4 wherein said first hinge member and second hinge member comprise means supporting said hasp member for rotation about said hinge axis and for axial movement along said hinge axis between an unlatched position in which said hasp member is free to rotate about said hinge axis and a latched position in which said hasp member is prevented from rotating about said hinge axis.

6. The electrical switch of claim 1 wherein said first hinge member and said second hinge member collectively comprise means for selectively preventing rotation of said hasp member toward said locking position.

7. The electrical switch of claim 6 wherein said first hinge member and second hinge member comprise means supporting said hasp member for axial movement along said hinge axis between an unlatched position in which said hasp member is free to rotate about said hinge axis, and a latched position in which said hasp member engages a stop preventing rotation of said hasp member toward said locking position.

8. The electrical switch of claim 7 wherein one of said first and second hinge members comprises arcuate fingers defining said hinge axis and another of said first and second hinge members comprises laterally extending pivot members which engage said arcuate fingers for rotation of said hasp member about said hinge axis and for axial movement along said hinge axis and wherein said arcuate fingers include a notch forming a stop which is engaged by said hasp member when said hasp member is axially positioned to said latched position.

9. The electrical switch of claim 1 wherein said hasp member has side tabs extending generally transversely therefrom extending toward said base plate with said hasp member in said locking position.

10. A mechanism for blocking movement of a switch handle which reciprocates along a path in a slot in a face of a switch housing, said mechanism comprising:

a base plate adapted to be secured to said housing adjacent a first end of said slot, said base plate having a first hinge member and a staple projecting outwardly from said face of said switch housing and terminating in a free end with a through aperture adjacent said free end; and a hasp member having a second hinge member at a hinge end for engaging said first hinge member to define a hinge axis about which said hasp member is rotatable between a locking position in which said hasp member overlays at least part of said slot to prevent movement of said handle in said slot, and an unlocked position in which said hasp member is rotated clear of said handle, said hasp member having an opening spaced from said hinge end so that said staple protrudes through said opening with said hasp member in the locking position.

11. The mechanism of claim 10 wherein said hasp member has a length selected to form at a free end an abutment which blocks movement of said handle away from said second end of said slot.

12. The mechanism of claim 11 wherein said hasp member has a flange on said free end forming said abutment which blocks movement of said handle away from said second end of said slot.

13. The mechanism of claim 11 wherein said first hinge member and second hinge member collectively comprise means for selectively preventing rotation of said hasp member toward said locking position.

14. The mechanism of claim 13 wherein said first hinge member and second hinge member comprise means collectively supporting said hasp member for axial movement along said hinge axis between an unlatched position in which said hasp member is free to rotate about said hinge axis, and a latched position in which said hasp member engages a stop preventing rotation of said hasp member toward said locking position.

15. The mechanism of claim 14 wherein one of said first and second hinge members comprises arcuate fingers defining said hinge axis and another of said first and second hinge members comprises laterally extending pivot members which engage said arcuate fingers for rotation of said hasp member about said hinge axis and for axial movement along said hinge axis, and wherein said arcuate fingers include a notch forming a stop which is engaged by said hasp member when said hasp member is axially positioned to said latched position.

16. The mechanism of claim 11 wherein said hasp member has a second opening spaced from said hinge end a distance which aligns said second opening with said handle when said handle is adjacent said first end of said slot and sized to retain said handle adjacent said first end of said slot with said hasp member in said locking position.

17. The mechanism of claim 16 wherein said first hinge member and second hinge member collectively comprise means for selectively preventing rotation of said hasp member toward said locking position.

18. The mechanism of claim 17 wherein said first hinge member and second hinge member comprise means collectively supporting said hasp member for axial movement along said hinge axis between an unlatched position in which said hasp member is free to rotate about said hinge axis, and a latched position in which said hasp member engages a stop preventing rotation of said hasp member toward said locking position.

19. The mechanism of claim 18 wherein one of said first and second hinge members comprises arcuate fingers defining said hinge axis and an other of said first and second hinge members comprises laterally extending pivot members which engage said arcuate fingers for rotation of said hasp member about said hinge axis and for axial movement along said hinge axis, and wherein said arcuate fingers include a notch forming a stop which is engaged by said hasp member when said hasp member is axially positioned to said latched position.

* * * * *